US005905473A

United States Patent [19]

Taenzer

[11] Patent Number: 5,905,473

[45] Date of Patent: May 18, 1999

[54] ADJUSTABLE ARRAY ANTENNA

[75] Inventor: Jon C. Taenzer, Los Altos, Calif.

[73] Assignee: ReSound Corporation, Redwood City, Calif.

[21] Appl. No.: 08/828,579

[22] Filed: Mar. 31, 1997

[51] Int. Cl.[6] ..... H01Q 19/00; H01Q 19/10

[52] U.S. Cl. ..... 343/834; 343/835; 343/837

[58] Field of Search ..... 343/834, 833, 343/835, 836, 837, 810, 813, 814, 815, 816, 817, 818, 819, 876; H01Q 19/00, 19/10

[56] References Cited

U.S. PATENT DOCUMENTS

| | | | |
|---|---|---|---|
| 3,199,103 | 8/1965 | Augustine | 342/127 |
| 3,325,816 | 6/1967 | Dutton | 343/837 |
| 3,725,938 | 4/1973 | Black et al. | 343/833 |
| 4,700,197 | 10/1987 | Milne | 343/837 |
| 5,235,343 | 8/1993 | Audren et al. | 343/837 |

*Primary Examiner*—Hoanganh Le
*Attorney, Agent, or Firm*—Burns, Doane, Swecker & Mathis LLP

[57] ABSTRACT

A passive reflective antenna located near an active receiving antennas is used to change the energy at the receiving antenna. The change in energy may be such as to remove a null created by multipath or to provide directionality, or both. The receiving antennas is permanently connected to a single receiver. When the receiver's output signal degrades below an acceptable level of quality, the reflective phase of the passive antenna's load is changed to change the phase of the reflected energy and achieve a desired effect (remove a null, change directionality, etc.) at the receiving antenna. In the simplest embodiment, the termination of the passive antenna is switched from an open circuit to a short circuit, or vice versa, to invert the phase of the reflected energy. The use of reflective elements in antenna designs, usually to achieve directionality, is well known (see the common Yagi or corner reflector antenna designs, for example), but these use passive reflector elements. The present invention, in contrast, employs active control of the reflective element. The term "reflective element" is used to mean an element that re-radiates RF energy. The position of a reflective element relative to the active receiving antenna (whether the reflective element receives RF energy from a waveform and before or after the active receiving antenna) is unimportant, so long as a portion of the re-radiated energy is picked up by the active receiving antenna and the phase with which the re-radiated energy is received is controllable.

16 Claims, 8 Drawing Sheets

ADJUSTABLE ARRAY ANTENNA

BACKGROUND OF THE INVENTION

1. Field of the Invention

The present invention relates to array antennas for communications systems, particularly RF microcell personal communications systems.

2. State of the Art

Wireless personal communications systems are known as exemplified by published International Application WO 96-41498 entitled Hearing Aid With Wireless Remote Processor, incorporated herein by reference. As described therein, a hearing aid system consists of an earpiece that can be hidden in the ear canal, and which communicates wirelessly with a remote processor unit (RPU). The RPU may be a belt pack, wallet or purse-based unit. Sounds from the environment are picked up by a microphone in the earpiece and sent with other information over a primary two-way wireless link to the RPU, where the audio signals are enhanced according to the user's needs. Signal processing is performed in the RPU rather than the earpiece to take advantage of relaxed size and power constraints. The enhanced audio signals may be combined with other information and transmitted from the RPU over the primary wireless link to the earpiece, where they are converted by a speaker to sounds that can only be heard by the user.

In an exemplary embodiment, communications between the RPU and the earpiece follow an interrogate/reply cycle. The reply portion of the primary wireless link (from the earpiece to the RPU) may use a reflective backscatter technique in which the RPU radiates a carrier signal and the earpiece uses a switch to change between a high backscatter antennas state and a low backscatter antenna state. An additional, optional secondary two-way wireless link can be used for communication between the RPU and a cellular telephone system or other source of information. Furthermore, an RPU keyboard, or voice recognition capabilities in the RPU, can be used to control hearing aid parameters and telephone dialing functions. Two earpieces and an RPU can be used in a binaural wireless system that provides hearing protection and noise cancellation simultaneous with hearing aid functions.

Although the system of WO 96-41498 arises out of the field of hearing health care, as may be appreciated from the foregoing description, the system is more broadly applicable to personal communications in general. Recently, attention has been drawn to the application of wireless personal communications systems to telecommunications and computing. At "ACM97: The Next 50 Years of Computing", for example, the prediction was made that in the future, personal computers will be wrist-sized, accompanied by a pair of reading glasses that present high-resolution images at a comfortable distance. A small, fitted earpiece and a "finger mouse" will be linked to other devices with low-power radio signals. Such a future is not far off.

One of the challenges presented in personal communications systems is to allow multiple such systems to function in close proximity to one another with no performance degradation (or graceful degradation) due to interference. An unofficial benchmark developed by the present assignee to test for robustness of communications in the presence of interference has been the "ten-person hug. " That is, ten persons each with a personal communications system of the type described should be able to form a group hug without experiencing significant performance degradation of their respective personal communications systems.

In a personal communications system as described, the RPU requires an antenna diversity system to mitigate against signal drop out due to signal nulls encountered in any real-world situation. Basically, the signal emanating from the earpiece antenna may reach the RPU's receiving antennas via numerous paths, due to multiple reflections from environmental objects. These reflections result in "multipath" problems.

Classical antenna diversity systems employ more than one antennas and either a) when the signal quality is measured to be below a predetermined threshold, the receiver input is switched to a different receiving antenna (with, hopefully, a better quality signal) or b) each antenna has its own receiver and the best quality received signal is utilized as the output signal. Any of various different measures of signal quality may be employed, such as signal strength, bit-error rate (BER), signal distortion, etc. Typically the antennas are spaced physically apart so that if one is in a null, the other or others are unlikely to also be in a null. A conventional diversity antenna system in accordance with the former technique is shown in FIG. 1. A conventional diversity antenna system in accordance with the latter technique is shown in FIG. 2.

In the first case a) active switching circuitry must be located in the antenna's signal path where signals are small and weak and subject to degradation by the switch. Furthermore, data transmission or reception must be interrupted periodically to perform a comparison of the signals received by the different antennas. Based on this comparison, one of the signals is selected. Such comparison, or "hunting," uses bandwidth that might otherwise be used for data transmission or reception. In the second case b) multiple receivers are required with the increase in size, weight, power, complexity, and, of course, cost.

In diversity antenna systems, multiple antennas function independently, usually without significant RF interaction. Apart from diversity antenna systems, directional antenna systems are also known. In directional antenna systems, also known as "beam steering" or "beam forming" antenna systems, the RF interaction between multiple antennas is controlled to realize the equivalent of a single antenna having a desired directionality. Directional antenna systems are most commonly used in radar applications, but are also being increasingly used in cellular communications, for example.

In some instances, passive reflector elements have been used to generate directionality. Referring to FIG. 3, for example, a linear antenna 31 forming a driven element has positioned adjacent to it a thin reflector element 33. With respect to the driven element, the reflector dipole is shorted out to cause the reflection of energy and is mistuned to a lower frequency (by using a longer element) to provide a phase delay that compensates for the reflective-to-active-element spacing d, thereby causing maximum radiation in the desired direction. Such a configuration is not adaptive and cannot be used to improve reception in a rapidly-changing RF environment.

A limited measure of adaptivity is attained using a conventional phased array antennas system of a type shown in FIG. 4. Multiple antennae 41 are coupled together using transmission lines ($\mathbf{1}_1$–, $\mathbf{1}_2$, $\mathbf{1}_3$). The transmission lines function as delay lines, the lengths of the transmission lines being chosen to exhibit the desired delay. Two different sets of transmission lines are provided, the transmission lines in each set having length chosen appropriately to achieve a desired directionality. RF switches 43 are used to switch between the two different sets of transmissions lines. When the RF switches are in one state, for example, the antennas system might be optimized for "broadside" reception. When the RF switches are in the other state, the system might be optimized for 45° reception. The limited degree of adaptivity of the system of FIG. 4 comes at the expense of increased size and cost.

Other conventional phased array antennas systems are fully adaptive. Referring to FIG. 5, for example, multiple antenna elements 51 are each coupled to individual phase shifters 53 and antenuators 55, the outputs of which are coupled to a common line feed 57. Referring to FIG. 6, a conventional phased array antenna system is shown using continuously adjustable RF phase shifters 61 and separate receivers (63, 65) for each element. (The separate receivers are provided with a common frequency reference $f_0$, element 64.) Using RF signal processing techniques, the signals from the two different elements (67, 69) can be summed (block 68) in any desired phase relationship.

None of the foregoing techniques is suitable for a compact, low-power, low-cost personal communications system. What is needed, then, is an antenna system that provides the benefits of known diversity and/or directional antenna systems but that is small, power efficient, and low-cost. The present invention addresses this need.

SUMMARY OF THE INVENTION

A passive reflective antenna located near an active receiving antenna is used to change the energy at the receiving antenna. The change in energy may be such as to remove a null created by multipath or to provide directionality, or both. The receiving antenna is permanently connected to a single receiver. When the receiver's output signal degrades below an acceptable level of quality, the reflective phase of the passive antenna's load is changed to change the phase of the reflected energy and achieve a desired effect (remove a null, change directionality, etc.) at the receiving antenna. In the simplest embodiment, the termination of the passive antenna is switched from an open circuit to a short circuit, or vice versa, to invert the phase of the reflected energy.

The use of reflective elements in antenna designs, usually to achieve directionality, is well known (see the common Yagi or corner reflector antenna designs, for example), but these use passive reflector elements. The present invention, in contrast, employs active control of the reflective element. The term "reflective element" is used to mean an element that re-radiates RF energy. The position of a reflective element relative to the active receiving antenna (whether the reflective element receives RF energy from a waveform and before or after the active receiving antenna) is unimportant, so long as a portion of the re-radiated energy is picked up by the active receiving antenna and the phase with which the re-radiated energy is received is controllable. By actively controlling the load impedance, the phase of the reflected signal can be controlled, giving an added measure of flexibility and usefulness. For example, a single, omni directional, active antenna surrounded by numerous passive reflective elements can be configured to produce a steered beam system where the reflective elements are the only elements to be controlled. Unlike other steered beam systems which are either mechanically steered or phased-array steered, the present method is more reliable, simpler, less costly, smaller, and more power efficient.

BRIEF DESCRIPTION OF THE DRAWING

The present invention may be further understood from the following description in conjunction with the appended drawing. In the drawing.

DETAILED DESCRIPTION OF THE PREFERRED EMBODIMENTS

The present invention will be described with particular reference to a personal communications system of the type previously described. In such a system, receiver diversity at the RPU is a real-world requirement. Directionality may also be used to advantage in such a system to minimize interference and power consumption. Because of the bi-directional (fully reversible) nature of antenna, directionality in one mode (transmit or receive) may be continued during the other mode if desired. Although described in relation to a personal communications system, the present invention is applicable to RF systems generally, particularly to antenna systems for radar, cellular, PCS and wireless microphone systems, among others.

Figure 1:
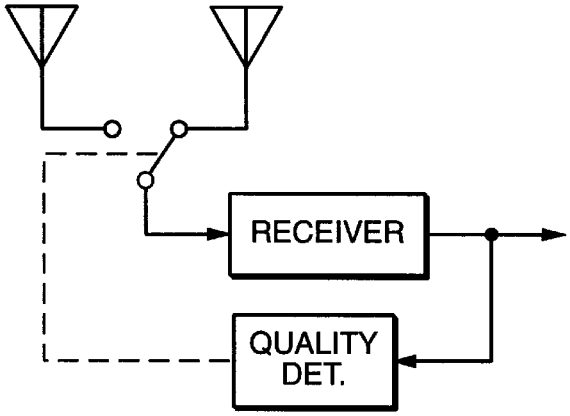
FIG. 1 (PRIOR ART)
FIG. 1 through FIG. 3 are block diagrams of conventional diversity antenna systems.
Figure 2:
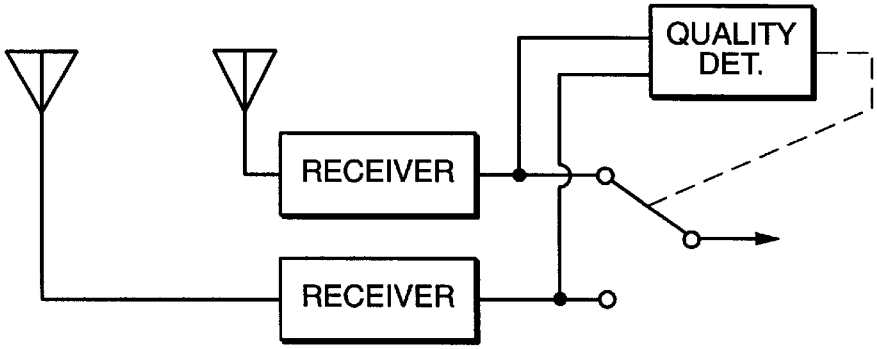
FIG. 2 (PRIOR ART)
Figure 3:
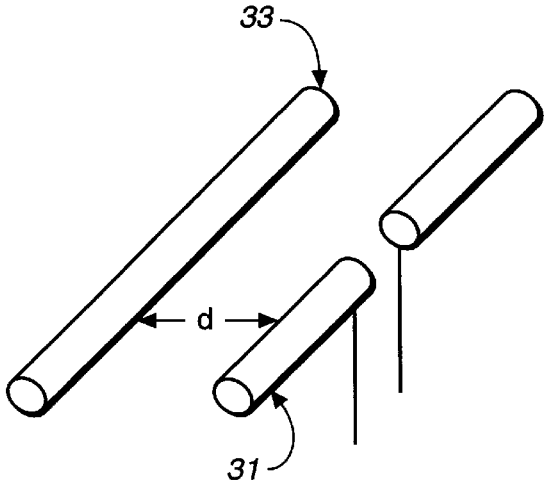
FIG. 3 (PRIOR ART)
Figure 4:
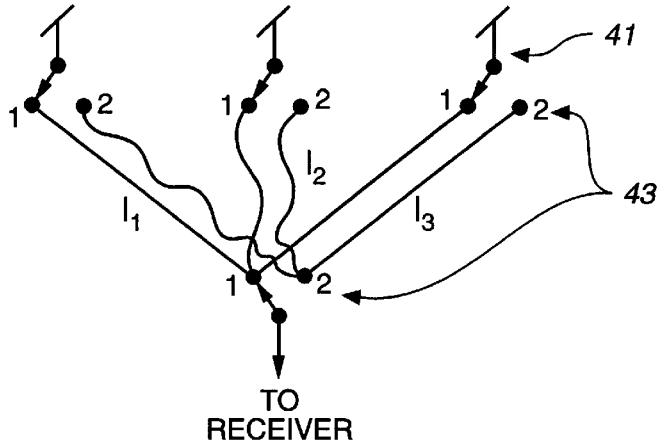
FIG. 4 (PRIOR ART)
FIG. 4 through FIG. 6 are block diagrams of conventional directional antenna systems.
Figure 5:
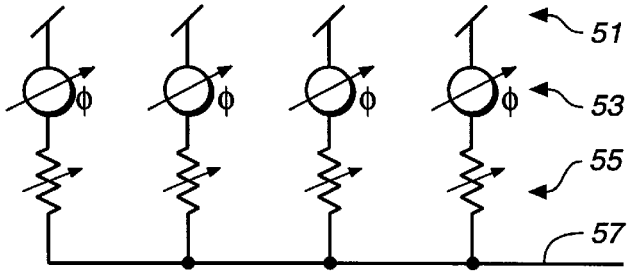
FIG. 5 (PRIOR ART)
Figure 6:
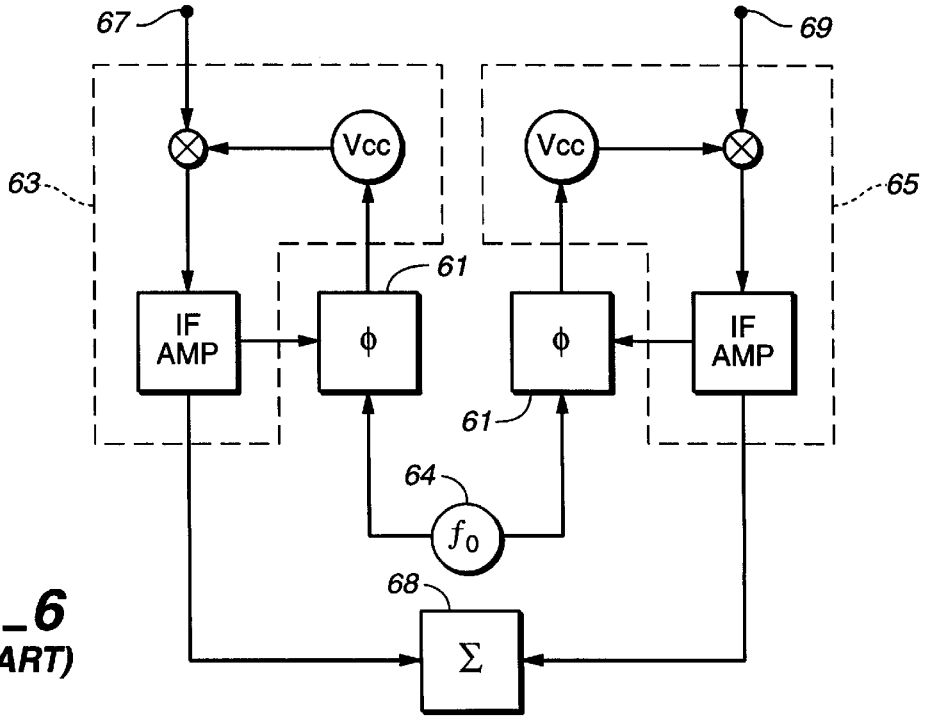
FIG. 6 (PRIOR ART)
Figure 7:
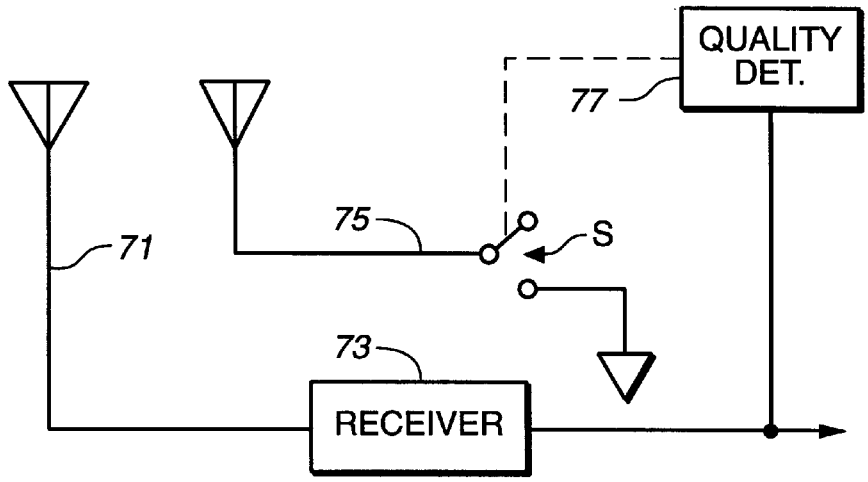
FIG. 7 is a block diagram of a multiple-antenna diversity system in accordance with one embodiment of the present invention.

Referring now to FIG. 7, a block diagram is shown of a multiple-antenna system in accordance with one embodiment of the present invention. A primary antenna 71 is permanently connected to a receiver 73. A secondary, passive antenna 75 is positioned in proximity to the primary antenna 71. The secondary antenna 75 is terminated through a switch S to ground. A signal quality determination block 77 is coupled to an output of the receiver 73.

Depending on the quality of reception, the switch S is placed in the open state, as shown, or the closed state. That is, to achieve control, the reflective element (secondary antenna 75) can simply be shorted or open-circuited to produce 0° or 180° phase switching.

Alternatively, an electronic load (not shown) which shifts the phase of the reflected energy by other angles can either be switched in or kept connected while the reflected phase is controlled electronically. The reflected phase may be controlled continuously if desired, i.e., the resulting directionality or other desirable trait can be continuously, or smoothly, changed (steered) in an "analog" way, stopping wherever is desired, and moved when decided.

Modification of the phase of the reflected signal can be accomplished by switching or continuous control. Switches can be electronic, mechanical, manual or any other method (even thermal). The simplest method (FIG. 7) involves using a switch to either short or open the reflective element to produce a 180° shift in the phase of the reflected signal. By switching between an open and a shorted transmission line (delay line) the phase shift, instead of 180°, can be made any value. By continuously controlling the phase shift of a permanently connected delay line or phase shifter, the phase of the reflected signal can be controlled smoothly and continuously or in steps.

Figure 13:
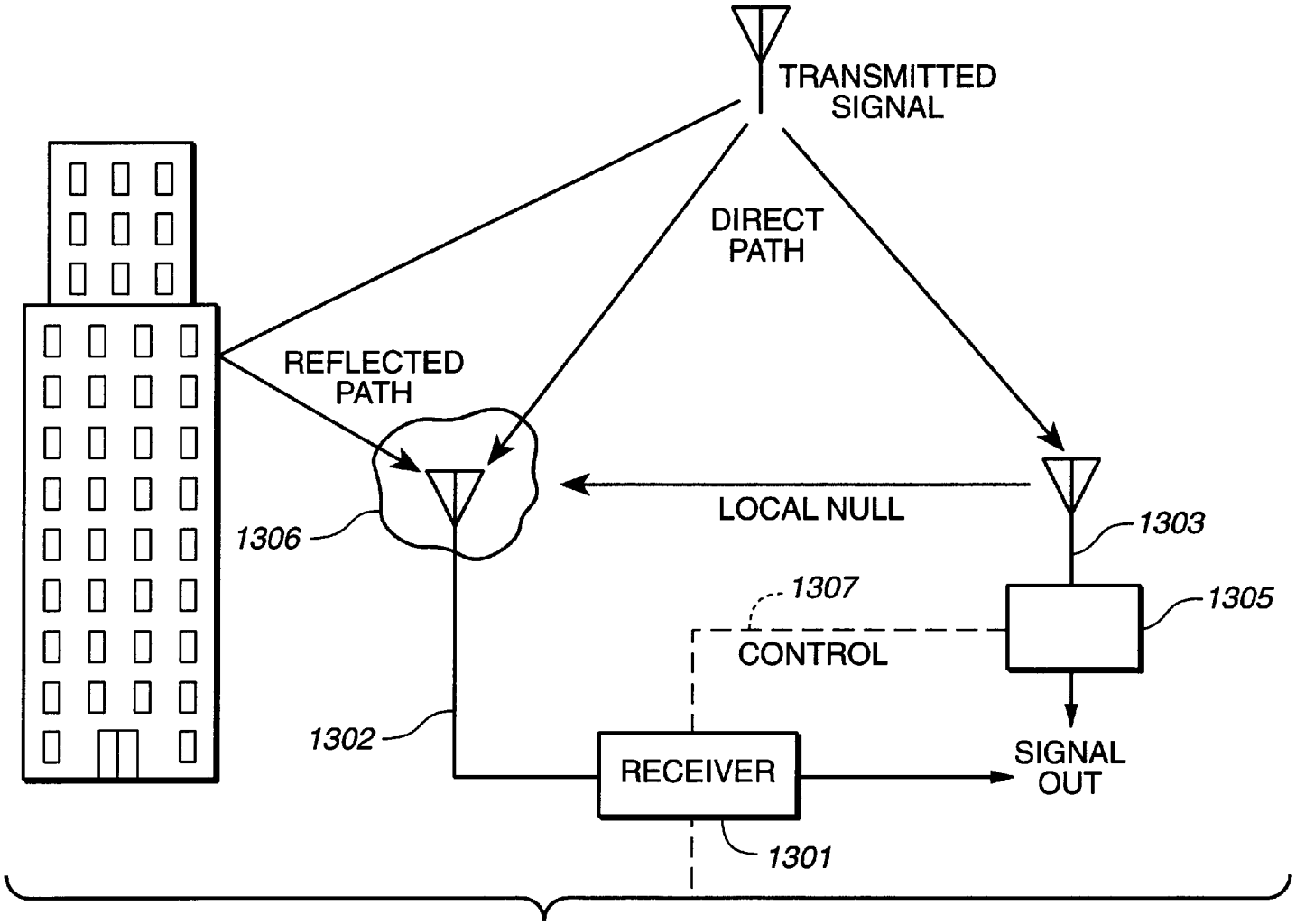
FIG. 13 is a diagram illustrating the use of reflected energy from one or more reflective elements to fill in the null in a multipath situation.

The effect of a multiple-antenna system such as that of FIG. 7 in a multipath situation is illustrated in FIG. 13. The multiple-antenna system includes a primary antenna 1302, a receiver 1301, a secondary, passive antenna 1303 terminated by a controllable load 1305 (such as a switch), and a control signal 1307. The receiver 1301 is assumed to incorporate means for determining the desired measure of signal quality and for producing the control signal 1307 in response to that measure.

In operation, multiple transmission paths can create spatial signal nulls at reception locations; for example the direct path and reflected path energy can sum at the receive antenna 1302 so as to produce a local spatial null 1306. Changing the phase of a portion of the reflected energy from the reflective element (secondary antenna) can change the summed energy at the receiving antenna 1302 so as to fill in the null. More particularly, a signal of interest follows a direct path to the primary antenna 1302 and also follows one or more reflected paths. At the primary antenna 1302, the direct signal and the reflected signal interfere destructively, causing a local spatial null at the primary antenna 1302. The signal of interest follows a direct path to the secondary antenna 1303 and is wholly or partially reflected with the reflected wave having a phase determined by the controllable load 1305 in response to the control signal 1307. The receiver adjusts the control signal 1307 to produce constructive interference between the reflected wave and the weak signal in the region of the local null to thereby increase the signal level.

Figure 8A:
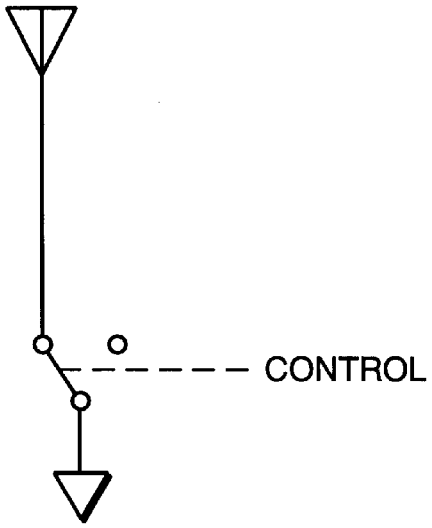
FIG. 8*a* through 8*g* are block diagrams illustrating various means of creating controllable phase shifts of the reflected energy from a reflective antenna element.
Figure 8B:
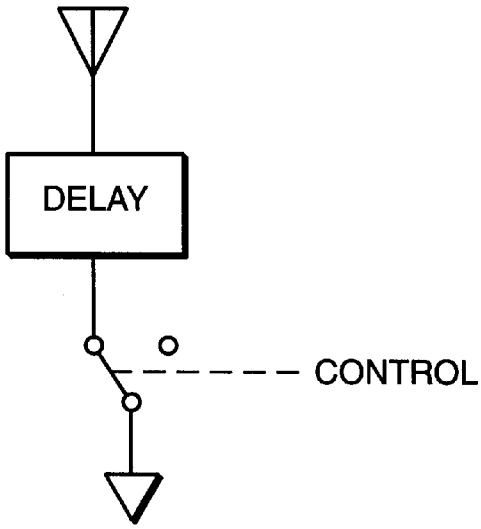
Figure 8C:
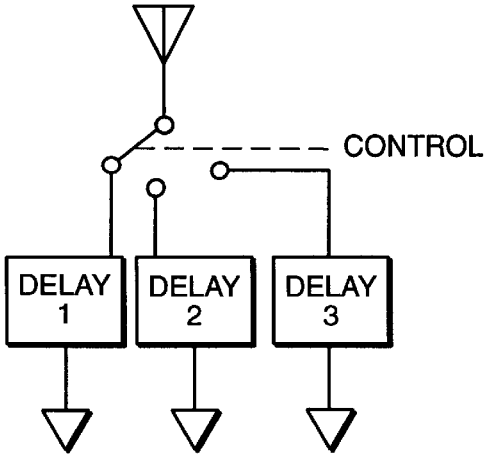
Figure 8D:
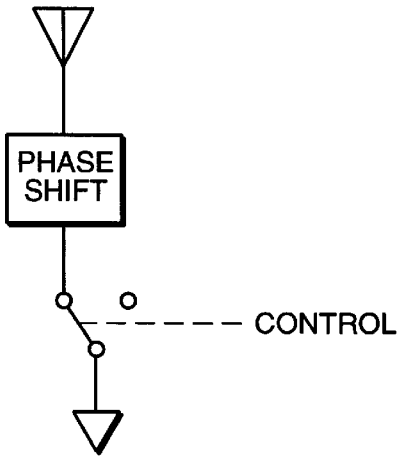
Figure 8E:
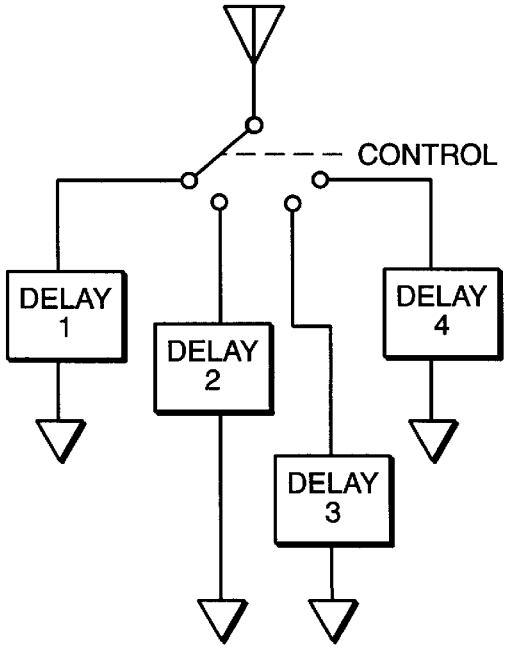
Figure 8F:
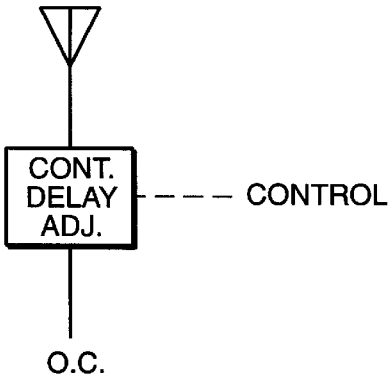
Figure 8G:
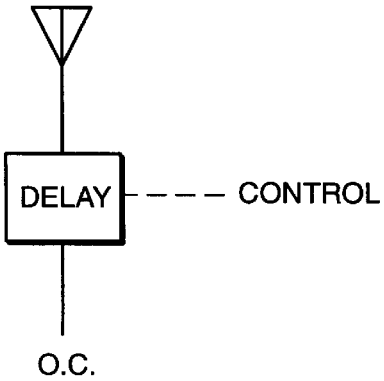

Various means may be used to create different controllable phase shifts of the reflected energy from a reflective antenna as shown in FIG. 8*a* through FIG. 8*g*. Referring to FIG. 8*a*, the simplest arrangement is a switch that may be controlled so as to terminate the reflective antenna in either a short circuit or an open circuit, producing a phase shift of 180°. A phase shift of other than 180° may be produced using a switch and a delay element such as a transmission line as in FIG. 8*b*. A similar arrangement, shown in FIG. 8*d*, uses a phase shifter instead of a delay element. Referring to FIG. 8*c*, a switch may be used to connect the reflective antenna through any one of multiple delay elements. A similar arrangement, shown in FIG. 8*e*, uses phase shifters instead of delay elements. A single continuously-adjustable delay element or phase shifter may be used as shown in FIG. 8*g* and FIG. 8*f*, respectively. Other combinations of the foregoing elements will be readily apparent.

Note that the specific nature of the reflective antenna termination in FIGS. 8*a* through FIG. 8*g* (whether short circuit, open circuit, etc.) is unimportant. The only requirement is that the reflection condition be established and that the reflection condition be controllable in some manner so as to control the phase of the reflected energy. Furthermore, although at least two distinct control states are required, any number of control states equal to or greater than two, including an infinite number of control states, may be used.

Figure 9:
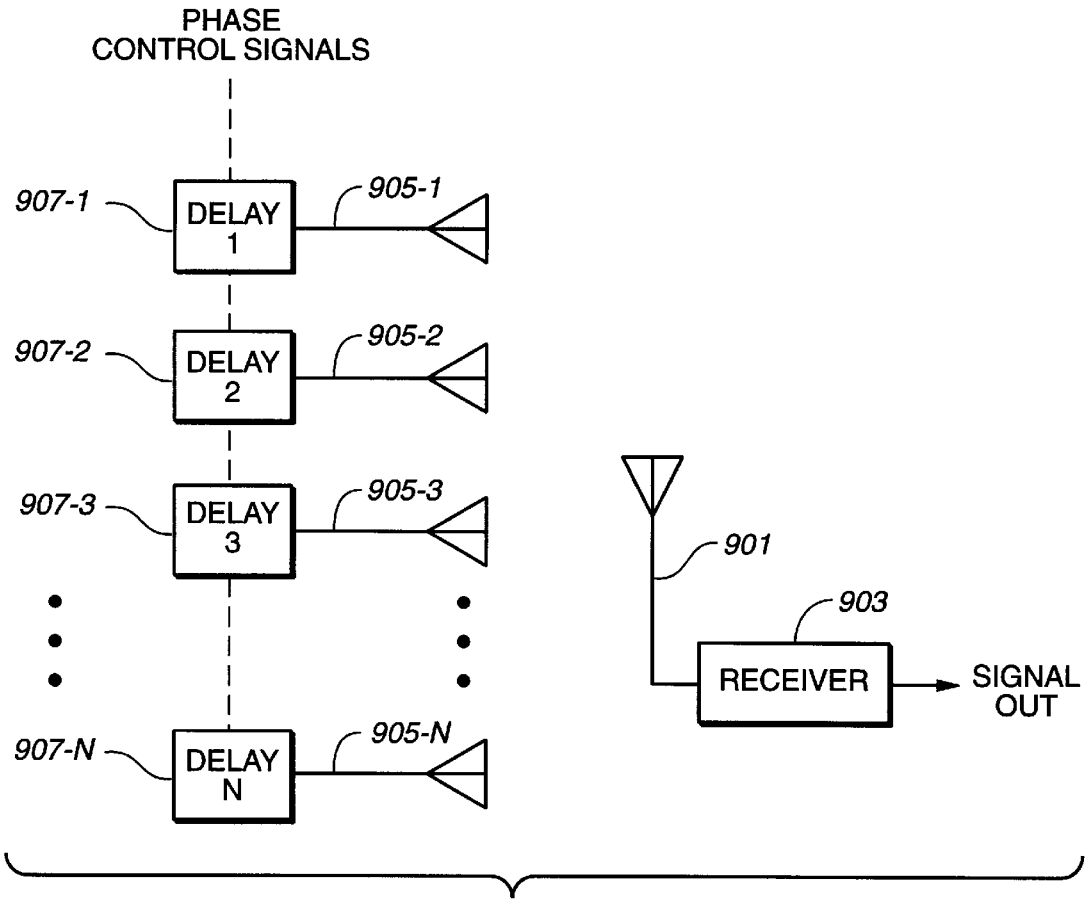
FIG. 9 is a block diagram of a multiple-antenna system in accordance with another embodiment of the invention.

As with conventional phased array antenna, multiple reflective antennas may be used within a single antenna system. Such a system is shown in FIG. 9. A primary antenna 901 is coupled to a receiver 903. Multiple secondary antennas 905-1 through 905-N are arrayed near the primary antenna 901. The respective secondary antennas are terminated with phase shifters 907-1 through 907-N (continuous or discrete), controlled by respective phase control signals.

Figure 10A:
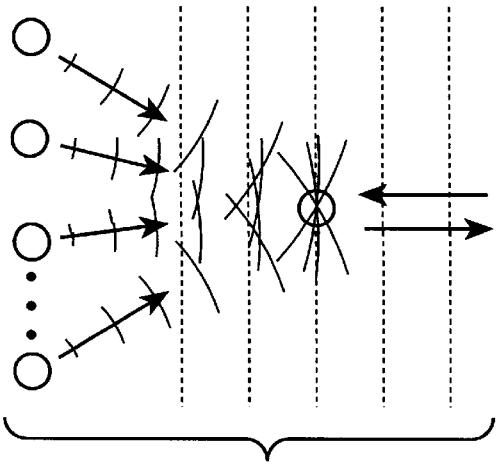
FIG. 10*a* is a diagram illustrating a plane wave being reflected from an array of reflective elements so as to focus reflected energy on an active element.

Such an array of secondary antenna may be used to reflect a plane wave so as to focus reflected energy on the active element, primary antennas 901. This result is shown in FIG. 10*a*. Algorithms for determining the appropriate phase shifts are known in the art and do not form part of the present invention.

Figure 10B:
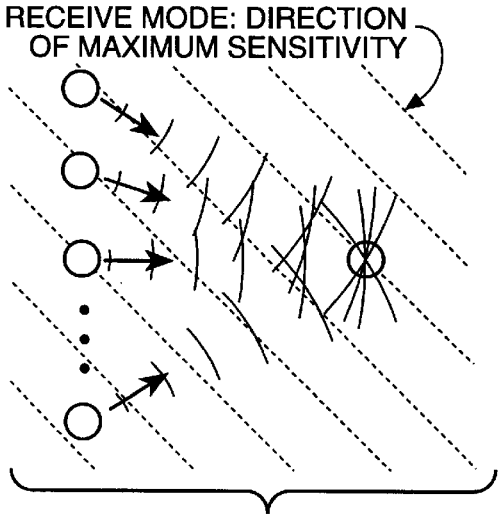
FIG. 10*b* is a diagram like that of FIG. 10*a*, illustrating how a change in the reflected phase can redirect the angle of greatest sensitivity for a reflective phased array.

Just as a conventional phased array antenna can be used to steer a null or a peak, similarly, an array of reflective antennas as in FIG. 9 can be used to redirect the angle of greatest sensitivity by changing the phase shifts of the respective reflective antennas appropriately. This result is shown in FIG. 10*b*.

Figure 11:
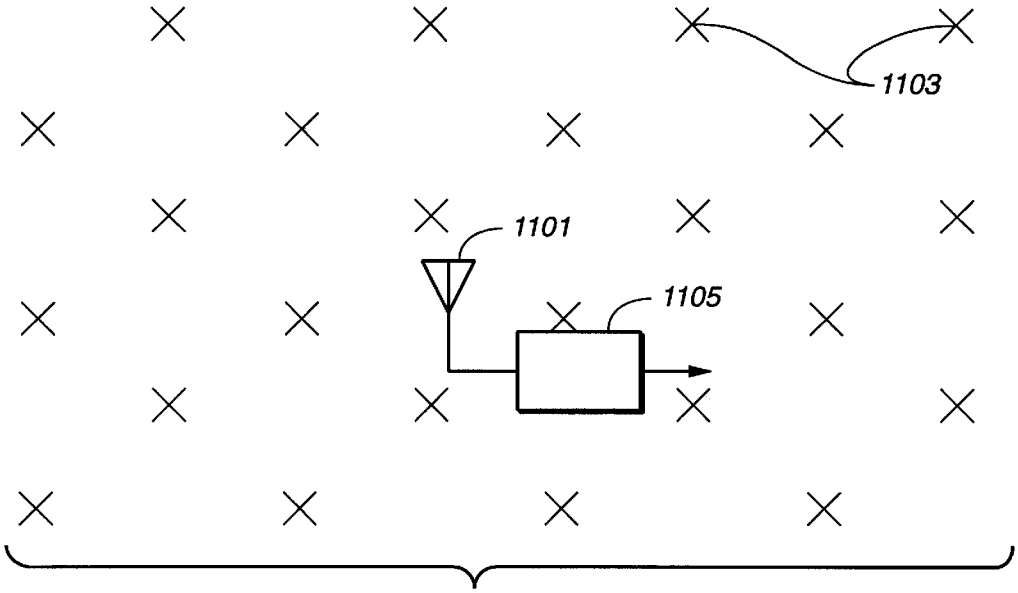
FIG. 11 is a representation of a multiple-antenna system in which one active element is placed in a field of phased reflectors.
Figure 12:
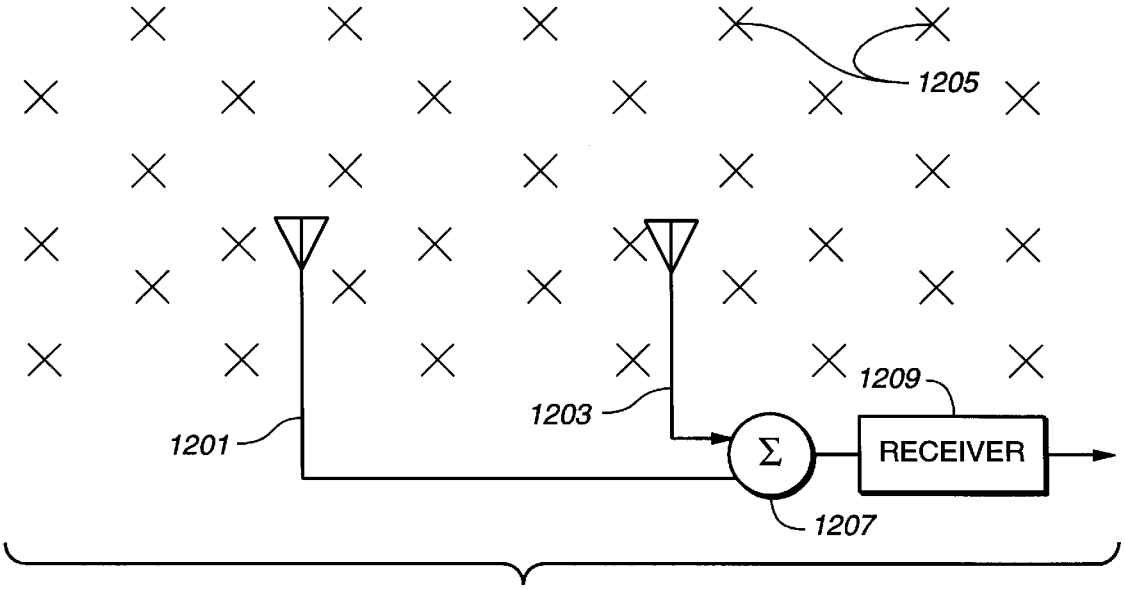
FIG. 12 is a diagram of a multiple-antenna system in which more than one active element is placed in a field of phased reflectors.

In FIG. 9, the reflective antennas are arrayed in a line. As shown in FIG. 11, the reflective antennas may also be arrayed in a 2D or 3D field. One or multiple active elements may be positioned in such a field. In the example of FIG. 11, a single primary antenna 1101 is positioned within a field of reflective antennae 1103. The primary antenna is connected to a receiver 1105. In the example of FIG. 12, two primary antennas (1201, 1203) are positioned within a field of reflective antennae 1205. Signals from the primary antennae are summed using a summer 1207 and input to a single receiver 1209. Alternatively, multiple independent receivers may be provided if desired, with the independent received signals being combined as in conventional diversity techniques or directional techniques.

Figure 14:
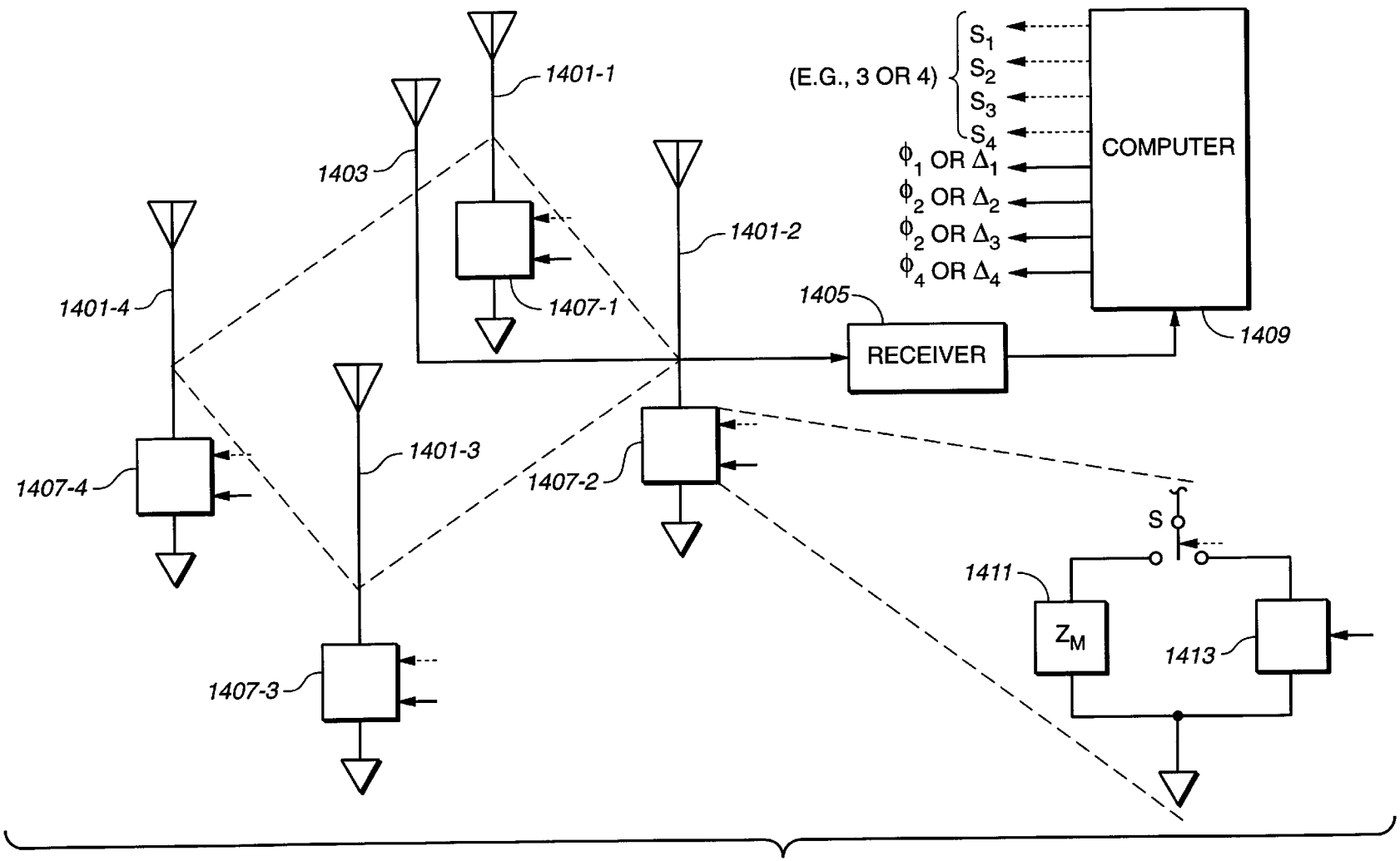
FIG. 14 is a block diagram of a multiple antenna system in accordance with a further embodiment of the invention.

Using reflective antennas arrayed in a 2D or 3D field, the benefits of diversity and directionality may be simultaneously obtained. For example, in FIG. 14, four reflective antennas 1401-1 through 1401-4 and a single active antenna 1403 may be arranged in a geometry in which the four reflective antennas are placed at the corners of a square and the single active antenna is placed in the middle of the square as shown in FIG. 14, the single active antenna being connected to a receiver 1405. The reflective antennas are connected to respective loads 1407-1 through 1407-4, shown in exploded view as including a switch S, a matching impedance load, and a phase-controllable load 1413. A computer 1409 produces control signals for the switches and the phase-controllable loads of each of the reflective antennas. The magnitude and phase of the load of one of the three reflective antennas might be controlled to minimize reflections from it. In this instance, three of the four reflective antennas will therefore be operative such that one of four different sets of three reflective antennas may be selected. The three operative reflective antenna may be controlled to achieve a desired directionality. As required by reception conditions, the system may switch to a different set of three reflective antenna but with reflective phases which still direct the beam in the same direction, thereby achieving diversity.

As compared to conventional multiple-antenna systems, which are typically bulky and costly, the described techniques provide for a multiple-antenna system that is small, low-power and low-cost, ideally suited for personal communications devices. The described techniques are characteristically simple, but allow for most or all of the advantages of sophisticated diversity antenna systems and of phased array antenna systems to be realized.

It will be apparent to those of ordinary skill in the art that the invention can be embodied in other specific forms without departing from the spirit or essential character thereof. The foregoing description is therefore considered in all respects to be illustrative and not restrictive. The scope of the invention is indicated by the appended claims rather than the foregoing description, and all changes which come within the meaning and range of equivalents thereof are intended to be embraced therein.

What is claimed is:

1. A method of enhancing an RF signal using an RF section having a primary antenna and at least one secondary antenna in the vicinity of the primary antenna, comprising the steps of:

producing an RF signal, the secondary antenna reflecting energy from the RF signal;

determining signal quality with respect to the primary antenna; and if said signal quality is below a predetermined threshold, changing the phase of RF energy reflected by the secondary antenna in the vicinity of the primary antenna to enhance reception of the RF signal.

2. The method of claim 1, wherein the RF section has multiple secondary antennas, comprising the further step of controlling the secondary antennas to focus reflected RF energy in relation to the primary antenna.

3. The method of claim 1, wherein electronically changing the phase comprises changing an electronic switch from one of an open state and a closed state to the other of the open state and closed state.

4. The method of claim 1, wherein the RF section comprises a variable delay line coupled to the secondary antenna, and wherein electronically changing the phase comprises applying a control signal to the variable delay line.

5. The method of claim 1, wherein the RF section comprises a variable phase shifter, and wherein electronically changing the phase comprises applying a control signal to the variable phase shifter.

6. The method of claim 1, wherein the RF section has multiple secondary antennas, comprising the further steps of:

selecting a first subset of secondary antennas;

determining signal quality with respect to the primary antenna; and if said signal quality is below a predetermined threshold, selecting a second subset of secondary antennas;

whereby signal quality is enhanced with respect to the primary antenna.

7. An RF section comprising:

an RF amplifier;

a primary antenna coupled to the RF amplifier;

a secondary antenna in the vicinity of the primary antenna; and means for determining signal quality with respect to the primary antenna and means for changing the phase of RF energy reflected by the secondary antenna to enhance RF reception depending on signal quality.

8. The RF section of claim 7, wherein the means for changing comprises an electronically controlled switch.

9. The RF section of claim 8, wherein the electronically controlled switch is coupled between the secondary antenna and ground.

10. The RF section of claim 9, wherein the electronically controlled switch is controlled so as to present at one time a substantially open circuit and at another time a substantially short circuit.

11. The RF section of claim 7, wherein the means for changing comprises a variable delay line.

12. The RF section of claim 7, wherein the means for changing comprises a variable phase shifter.

13. The RF section of claim 7, further comprising multiple secondary antennas.

14. The RF section of claim 13, wherein the multiple secondary antennas are arrayed in a two-dimensional array.

15. The RF section of claim 13, wherein the multiple secondary antennas are arrayed in a three-dimensional array.

16. The RF section of claim 7, further comprising multiple primary antennas.

* * * * *